US006691694B2

(12) United States Patent
Stinson

(10) Patent No.: US 6,691,694 B2
(45) Date of Patent: Feb. 17, 2004

(54) BOW-MOUNTED ARROW QUIVER WITH STACKED ARROW MOUNTING

(75) Inventor: Robert E. Stinson, Acme, MI (US)

(73) Assignee: Kwikee Kwiver Company, Inc., Acme, MI (US)

( * ) Notice: Subject to any disclaimer, the term of this patent is extended or adjusted under 35 U.S.C. 154(b) by 0 days.

(21) Appl. No.: 10/352,521

(22) Filed: Jan. 28, 2003

(65) Prior Publication Data

US 2003/0140913 A1 Jul. 31, 2003

Related U.S. Application Data

(60) Provisional application No. 60/352,463, filed on Jan. 28, 2002.

(51) Int. Cl.[7] ..... F41B 5/06

(52) U.S. Cl. ..... 124/86; 124/25.5; 224/916

(58) Field of Search ..... 124/1, 25.5, 25.7, 124/86, 88; 224/916

(56) References Cited

U.S. PATENT DOCUMENTS

| | | | | |
|---|---|---|---|---|
| 2,908,432 | A | | 10/1959 | Kent |
| 2,954,764 | A | | 10/1960 | Stinson |
| 2,980,305 | A | | 4/1961 | Reese |
| 3,116,730 | A | | 1/1964 | Tingley |
| 3,337,099 | A | | 8/1967 | Rose |
| 3,465,928 | A | * | 9/1969 | Osterholm |
| 3,490,662 | A | * | 1/1970 | Ramsey |
| 3,561,651 | A | | 2/1971 | Ramsey |
| 3,716,174 | A | | 2/1973 | Ehlert |
| 3,777,734 | A | | 12/1973 | Rose |
| 4,020,984 | A | | 5/1977 | Morris |
| 4,156,496 | A | | 5/1979 | Stinson |
| 4,607,606 | A | | 8/1986 | Schaar |
| 4,995,372 | A | | 2/1991 | Topel |
| D331,319 | S | | 12/1992 | Stinson |
| 5,452,703 | A | | 9/1995 | Bateman, III |
| 5,775,313 | A | | 7/1998 | Bresette et al. |
| 6,006,734 | A | * | 12/1999 | Sodaro |
| 6,390,085 | B1 | | 5/2002 | Stinson |

* cited by examiner

*Primary Examiner*—John A. Ricci
(74) *Attorney, Agent, or Firm*—Price, Heneveld, Cooper, DeWitt & Litton

(57) ABSTRACT

A new form of bow-mounted arrow quiver, which will safely and satisfactorily carry a plurality of different kinds of broadhead-tipped arrows, particularly, mechanical broadhead arrows, regardless of shaft size (diameter), while maintaining each different broadhead out of contact with the others contained within the broadhead shield.

20 Claims, 3 Drawing Sheets

BOW-MOUNTED ARROW QUIVER WITH STACKED ARROW MOUNTING

CROSS-REFERENCE TO RELATED APPLICATIONS

This application claims the benefit of U.S. Provisional Patent Application Serial No. 60/352,463, entitled "BOW-MOUNTED ARROW QUIVER WITH STACKED ARROW MOUNTING," which was filed Jan. 28, 2002, and which is hereby incorporated herein by reference in its entirety. This application is also related to U.S. Pat. No. 6,390,085, entitled "ARROW QUIVER FOR RETRACTIBLE-BLADE BROADHEADS," issued May 21, 2002, which is incorporated herein by reference in its entirety.

BACKGROUND OF THE INVENTION

In the earlier and related patent referenced above and incorporated herein, a novel new arrow quiver configuration is disclosed and claimed which is specially suited for use with the retractable-blade arrowheads known as "mechanical" broadheads, in which the blades are pivotally mounted and arranged to be retracted prior to shooting and interlocked or indexed in the retracted position until impact, whereupon they spring forward to strike the target with increased effect. As there disclosed, the earlier design for such a quiver included a pair of resilient arrow holders mounted in spaced relation upon a supporting spine or stem member, together with a generally cup-like broadhead shield mounted at the top of the stem member which contains an arrow tip support inside the broadhead shield. The tip support has a series of laterally aligned specially configured recesses or pockets for receiving the tips of the broadheads while maintaining the retracted broadhead blades out of contact with all other nearby surfaces, thereby preventing premature opening of the retracted, spring-loaded mechanical broadhead blades.

In this arrangement, each of the spaced arrow holders included a series of arrow shaft-receiving apertures arranged in a row, and the apertures of the two arrow holders were aligned with one another and with a designated one of the broadhead tip pockets. Therefore, each aligned pair of arrow holder apertures served to guide an arrow disposed therein directly into the designated tip pocket for that arrow, for easy and accurate loading of the arrows into the quiver, and the tip pockets served as pivotal levering points which allowed easy removal of the arrows by lifting them upward from their arrow holders.

SUMMARY OF THE INVENTION

In accordance with the present invention, a further improvement is provided for the above-mentioned concept and structure, in accordance with which a larger quantity of arrows may be safely and satisfactorily retained without mutual contact or other impact such as would prematurely trigger the closed mechanical blades, and also by which a plurality of arrows with different shaft diameters may be so held and carried, thereby adding greater versatility and operational flexibility to the resulting quiver.

Briefly stated, the present invention provides a new form of bow-mounted arrow quiver which will safely and satisfactorily carry a plurality of different kinds of broadhead-tipped arrows, particularly mechanical broadhead arrows, regardless of shaft size (diameter), while maintaining each different broadhead out of contact with the others contained within the broadhead shield.

In a more particular sense, the invention provides a bow-mounted arrow quiver having a pair of mutually spaced arrow-holders which have a plurality of differently sized arrow shaft-receiving apertures, arranged in sets containing at least two such differently sized apertures or passages which communicate with one another through a connective slot, whereby an arrow shaft of either larger or smaller diameter may be contained in any given such set of receiving apertures or passages by simply moving it to the most appropriately sized receiving aperture or passage. Further, the invention provides a new and novel form of arrow tip-receiving pocket arrays mounted inside the broadhead shield, which is specially configured to receive only the forward part of an arrowhead while maintaining the blades out of contact with all other adjacent structures, such tip pockets being disposed in an effective mutually-spaced two-dimension array and also preferably being advantageously formed in a one-piece support member which also may provide a liner for protectively covering the adjacent interior sides of the broadhead shield.

DESCRIPTION OF PREFERRED EMBODIMENTS

Figure 1:
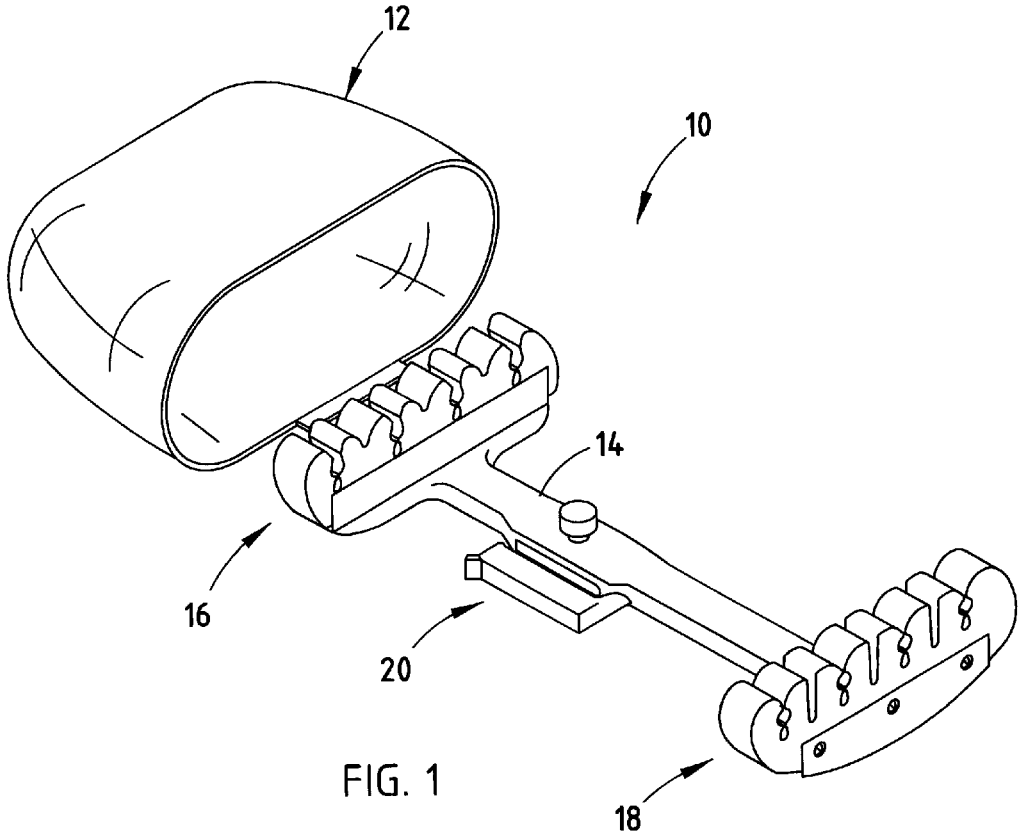
FIG. 1 is a perspective view showing the overall nature of the present invention.

U.S. Pat. No. 6,390,085 generally describes a bow-mounted quiver device, which lack the particular features disclosed herein. Basically, and with reference to FIG. 1 herein, the quiver device 10 comprises a domed or cup-shaped broadhead shield 12 mounted atop a spine-like stem 14 which carries a pair of spaced arrow holders 16 and 18. Each of these constitute a resilient rubber-like member having a series of laterally adjacent but mutually spaced slots leading into openings, which receive and retain the shaft of an arrow, to thereby mount it upon the quiver, with the arrangement being such that the shaft-receiving slots in each of the arrow holders 16, 18 are correspondingly aligned so that each pair of them retains the shaft of a single arrow and holds it in place with its broadhead disposed inside the shield 12. As will be understood by those skilled in the art, the quiver 10 also includes a mounting bracket structure 20, which is unnecessary to describe herein since already shown in the inventor's prior U.S. Pat. Nos. 4,156,496; 5,265,585; and 5,566,665 and now well known in the art.

Figure 2:
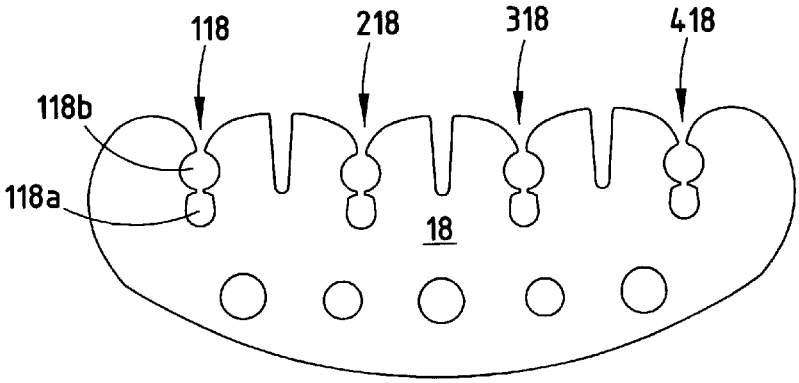
FIG. 2 is an enlarged elevational view showing the structure of the arrow holder mounted at the bottom of the quiver.
Figure 3:
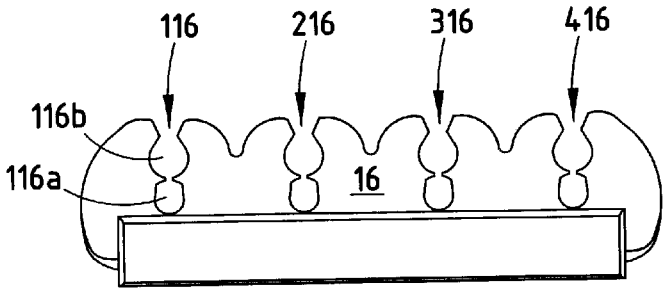
FIG. 3 is an elevational view similar to FIG. 2 but showing the arrow holder mounted near the broadhead shield.

FIGS. 2 and 3 show further details of the two arrow holders 16 and 18. The holders 16 and 18 are mounted in the same manner on the quiver stem 14 as those of U.S. Pat. No. 6,390,085. In accordance with the present invention, however, each of the arrow holders 16, 18 is made to be a compound device, i.e., each of the arrow-receiving slots 116, 216, 316, 416, and 118, 218, 318, 418 defines two (or potentially more) differently-sized arrow shaft-retaining passages 116*a*, 116*b*, 118*a*, 118*b*, etc. More particularly, the lower such passages 116*a*, 118*b*, etc., are smaller in diameter than the upper passages 116*b*, 118*b*, etc., and each such set in each arrow holder is interconnected by a narrower opening extending between them. The lower such passage is sized to receive and lightly grip carbon-shaft arrows, while the upper passage holds the new carbon-aluminum shafts and the standard aluminum shafts, which are larger in diameter. For example, the smaller aperture 116*a* may be on the order of 0.20 inches, and the larger apertures 116*b* on the order of about 0.28 inches in diameter.

The resiliency requirements of a well-functioning arrow holder do not permit use of a single-diameter passage/aperture to accommodate these differing arrow shaft diameters and it has, until now, been standard practice to change the arrow holders on an existing quiver to accommodate whichever size arrows the hunter wishes to use at a given time. This is clearly an inconvenience, and makes it impossible to load and carry an assortment of different types of arrows at the same time. The present configuration provides a very effective solution to this problem and inconvenience, while at the same time providing a quiver that will properly and effectively mount twice as many arrows as those generally used heretofore.

It should be pointed out that the arrow holders 16, 18 and their respective arrow-receiving passages 116*a*, 118*a*, etc., are arranged and mounted upon stem 14 so as to mutually align each of the sets of passages 116*a*, 118*a*, 116*b*, 118*b*, etc., between the two spaced arrow holders, so that each such set of aligned passages holds an individual arrow in a properly spaced and well-organized disposition. To accommodate such a dual or compound array of arrows, a corresponding array of particularly configured and located tip pockets 22, 24, 26, 28, and 30, 32, 34, and 36, respectively (FIGS. 4, 5, 6, and 7) are provided in broadhead shield 12. As illustrated in these figures, the tip pockets 22–36 inclusive are formed in the bottom of a liner/insert 38 that mounts inside the outer shell-like part of the broadhead shield 12, fitting snuggly inside the latter. The liner/insert 38 preferably comprises a dished member with a generally flat or planar bottom/base portion 40 that is preferably a one-piece molded part, formed from a moderately flexible rubber-like material. In the most preferred form, base portion 40 comprises a flat end wall 42 having a series of thickened protrusions 44 on its rear surface in which the tip pockets 22–36 inclusive are formed, with a series of narrow ribs 46 extending laterally from each tip pocket protrusion 44 outwardly to the edge of the shield 12, to provide additional stabilization and support for the end of the liner insert.

Figure 4:
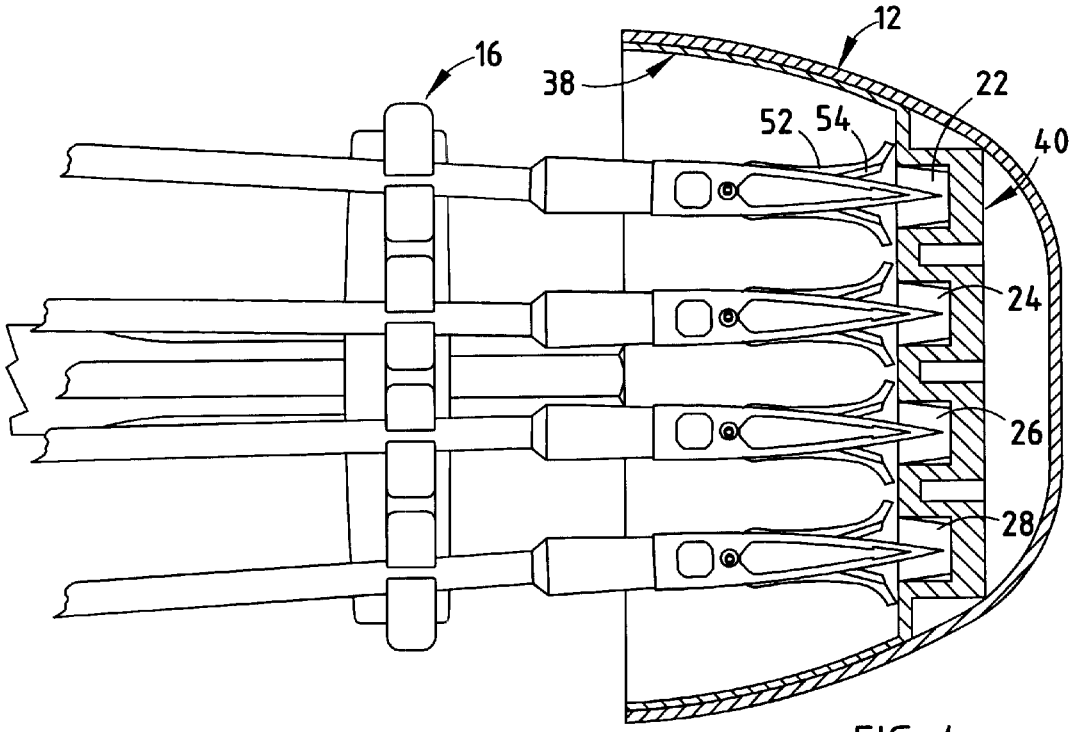
FIG. 4 is a fragmentary sectional plan view showing a plurality of arrows mounted in place upon the quiver, further showing arrow tips engaging the tip pockets inside the broadhead shield.
Figure 5:
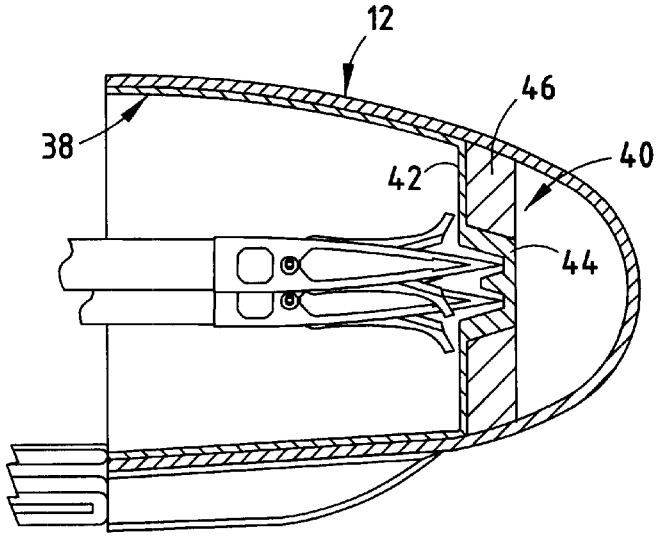
FIG. 5 is a fragmentary, enlarged sectional elevation taken along the plane perpendicular to that shown in FIG. 4.
Figure 6:
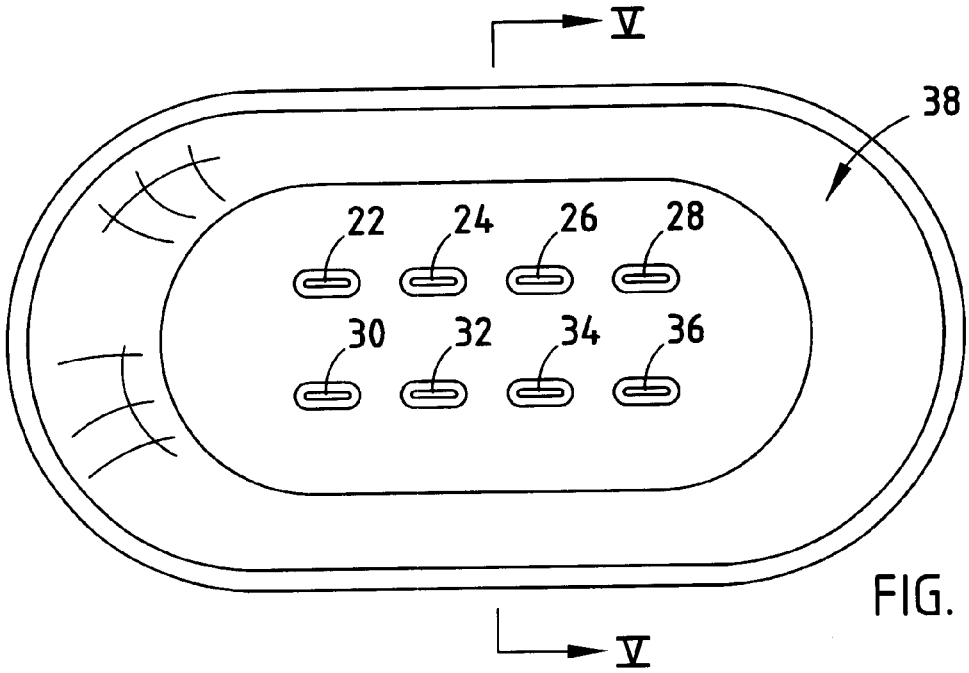
FIG. 6 is an end elevational view showing the arrangement of the tip pockets inside the broadhead shield and further identifying plane V—V utilized in FIG. 5.
Figure 7:
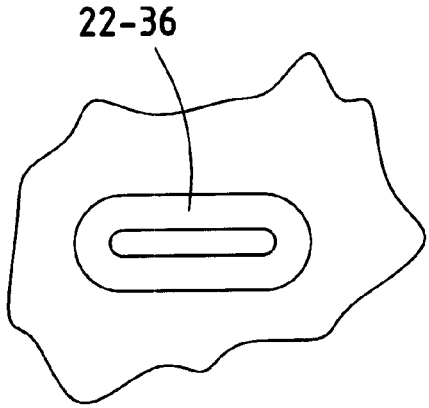
FIG. 7 is an enlarged side elevational view showing a single tipped pocket.

As may be seen from FIGS. 4, 5, and 6, the tip pockets 22–36 inclusive are arrayed in two superposed sets of four, providing sets of vertically aligned top and bottom pockets (e.g., 22 and 30, for example) at each of four different locations. These locations match the arrow alignment provided by the arrow shaft retention passages (e.g., 116*a*, 118*a*, and 116*b*, 118*b*, for example) provided in the two arrow holders 16, 18 (see FIGS. 2 and 3, as well as FIGS. 4, 5 and 6). Thus, each individual arrow mounted in the quiver on arrow holders 16, 18 will automatically be aligned with a corresponding tip pocket, such that by initially mounting a given arrow in a given set of retention passages in the arrow holders 16, 18, with the broadhead either outside the entrance of broadhead shield 12, or only partially inserted into the latter, the arrow may then be slid forwardly (i.e., upwardly as mounted on the bow) toward and into the broadhead shield 12, and the pointed end extremity of the broadhead 52 will automatically be guided directly into a corresponding tip pocket 22, etc.

As in the case of U.S. Pat. No. 6,390,085 referenced above, each of the tip pockets 22–36 inclusive (which are all identical) are particularly formed to receive only the extending pointed portion of the broadhead 52, leaving the folded or retracted blades (e.g. 54) out of contact with all parts of the liner/insert 38, and the spacing of arrows provided by the arrow holder passage 116*a*, 118*a*, etc., and disposition of the tip pockets 22–36 inclusive is such that no two adjacent arrowheads make contact with one another, particular the folded blades thereof. For example, the depth of the tip pockets should be limited to accomplish this, e.g., not exceeding about one-fourth of an inch in relation to current broadhead dimensions. Thus, undesired rattles or the like and inadvertent release of the folded and spring-loaded broadhead blades is prevented at all times. Further, each of the tip pockets 22–36 inclusive is preferably shaped in the manner illustrated in FIGS. 4–7 inclusive, being generally oval-shaped and laterally elongated, with angularly sloping (e.g., tapered) sides generally emulating the conically tapered point on the broadheads 42, but the end extremity of the tip pockets is preferably flat, as illustrated. Thus, slight variations in arrow alignment due to reasonable manufacturing and fabrication tolerance variations are readily accommodated by each of the tip pockets, which are preferably somewhat larger in cross-section than corresponding parts of the broadhead, which they receive.

It will readily be seen from the foregoing that a novel and inventive improvement has been provided, by which a plurality of arrows having different shaft sizes may easily and securely be mounted in the same quiver, with the tip of each separately and securely pocketed in a manner which prevents contact with adjacent arrowheads and inadvertent triggering (release) of the folded broadheads (in which regard, the limited depth of the tip pockets ensures that the folded blades do not make contact with the wall 42 or any adjacent structure. Of course, while the foregoing description has primarily been given in connection with the more recently introduced mechanical broadhead-equipped arrows, the quiver 10 will nonetheless readily accommodate older-styled broadheads as well, which have fixed blades. In either case, the removal of arrows from the quiver from their securely mounted position is readily accomplished by grasping the arrow shaft somewhere near the bottom arrow holder 18 and lifting it upwardly and away from the quiver stem 14, whereupon the arrow shaft first leaves arrow holder 18 and then is levered out of the forward or upper arrow holder 16 due to the pivotal engagement of the arrow point with the sides of its tip pocket, a principal functional advantage provided by the structural arrangement described. In this manner, arrow removal is positive and easy, with no risk of impacting the arrowhead of the arrow being removed with those adjacent it, inasmuch as the tip pocket arrangement precludes this while at the same time contributing greatly to the easy and positive removal of mounted arrows from the quiver.

The above description is considered that of the preferred embodiments only. Modifications of these embodiments in accordance with the invention will occur to those skilled in the art and to those who make or use the invention. Therefore, it is to be understood that the embodiments described above are merely for illustrative purposes and not intended to limit the scope of the invention, which is generally set forth in the appended Statements of Invention, and/or corresponding claims, as interpreted according to the principles of patent law, including the doctrine of equivalents.

What is claimed is:

1. An arrow quiver, comprising:

a shield having a generally cup-shaped portion with an open end;

a pair of spaced aligned arrow holders each including a resilient member having a series of laterally adjacent spaced arrow shaft slots leading into openings for receiving a shaft of an arrow, wherein each of the slots includes an upper arrow shaft retention passage that is interconnected to a lower arrow shaft retention passage, and wherein the lower arrow shaft retention passage is smaller than the upper arrow shaft retention passage; and a liner disposed within the cup-shaped portion, the liner having a perimeter wall and a base, the base having a plurality of tip pockets for receiving arrowhead tips, wherein one of the tip pockets is aligned with each of the upper and lower arrow shaft retention passages of each of the spaced slots.

2. The arrow quiver of claim 1, wherein the resilient member is formed of a rubber material.

3. The arrow quiver of claim 1, wherein the liner is formed of a rubber material.

4. The arrow quiver of claim 1, further including:

a stem attaching the pair of spaced aligned arrow holders to the shield.

5. The arrow quiver of claim 1, wherein the tip pockets are one of elliptical-shaped and oval-shaped, and wherein the tip pockets are laterally elongated.

6. The arrow quiver of claim 1, wherein a depth of each of the tip pockets is selected to only engage an end of an arrowhead.

7. The arrow quiver of claim 6, wherein the arrowhead is a broadhead.

8. The arrow quiver of claim 1, wherein sides of each of the tip pockets are angularly sloping and end extremities of the tip pockets are one of blunt-ended or flat-bottomed.

9. An arrow quiver, comprising:

a shield having a generally cup-shaped portion with an open end and a base; and a pair of spaced aligned arrow holders each including a resilient member having a series of laterally adjacent spaced arrow shaft slots leading into openings for receiving a shaft of an arrow, wherein each of the slots includes an upper arrow shaft retention passage that is interconnected to a lower arrow shaft retention passage, and wherein the lower arrow shaft retention passage is smaller than the upper arrow shaft retention passage, where the base includes a plurality of tip pockets for receiving arrowhead tips, and where one of the tip pockets is aligned with each of the upper and lower arrow shaft retention passages of each of the spaced slots.

10. The arrow quiver of claim 9, wherein the resilient member is formed of a rubber material.

11. The arrow quiver of claim 10, further including:

a stem attaching the pair of spaced aligned arrow holders to the shield.

12. The arrow quiver of claim 10, wherein the tip pockets are one of elliptical-shaped and oval-shaped, and wherein the tip pockets are laterally elongated.

13. The arrow quiver of claim 10, wherein a depth of each of the tip pockets is selected to only engage an end of an arrowhead.

14. The arrow quiver of claim 13, wherein the arrowhead is a broadhead.

15. The arrow quiver of claim 9, wherein sides of each of the tip pockets are angularly sloping and end extremities of the tip pockets are one of blunt-ended or flat-bottomed.

16. An arrow quiver, comprising:

a shield having a generally cup-shaped portion with an open end;

a pair of spaced aligned arrow holders each including a resilient rubber member having a series of laterally adjacent spaced arrow shaft slots leading into openings for receiving a shaft of an arrow, wherein each of the slots includes an upper arrow shaft retention passage that is interconnected to a lower arrow shaft retention passage, and wherein the lower arrow shaft retention passage is smaller than the upper arrow shaft retention passage; and a rubber liner disposed within the cup-shaped portion, the liner having a perimeter wail and a base, the base having a plurality of tip pockets for receiving broadhead tips, wherein one of the tip pockets is aligned with each of the upper and lower arrow shaft retention passages of each of the spaced slots, and wherein the tip pockets are one of elliptical-shaped and oval-shaped, and where the tip pockets are laterally elongated.

17. The arrow quiver of claim 16, further including:

a stem attaching the pair of spaced aligned arrow holders to the shield.

18. The arrow quiver of claim 16, wherein a depth of each of the tip pockets is selected to only engage an end of a broadhead and not blades of the broadhead.

19. The arrow quiver of claim 16, wherein sides of each of the tip pockets are angularly sloping.

20. The arrow quiver of claim 16, wherein end extremities of the tip pockets are one of blunt-ended or flat-bottomed.

* * * * *

UNITED STATES PATENT AND TRADEMARK OFFICE

CERTIFICATE OF CORRECTION

PATENT NO. : 6,691,694 B2
DATED : February 17, 2004
INVENTOR(S) : Robert E. Stinson It is certified that error appears in the above-identified patent and that said Letters Patent is hereby corrected as shown below:

Column 2,
Line 48, “lack” should be -- lacks --;

Column 3,
Line 10, “118*b*” should be -- 118*a* --;

Column 4,
Line 16, “particular” should be -- particularly --;
Line 43, after “structure” insert -- ) --; and Column 6,
Line 36, “wail” should be -- wall --.

Signed and Sealed this

First Day of June, 2004

JON W. DUDAS
*Acting Director of the United States Patent and Trademark Office*